73-151 SR
5/24/83 OR 4,384,483

United States Patent [19]
Dellinger et al.

[11] 4,384,483
[45] May 24, 1983

[54] PREVENTING BUCKLING IN DRILL STRING

[75] Inventors: Thomas B. Dellinger, Duncanville; Wilton Gravley, Carrollton; John E. Walraven, Dallas, all of Tex.

[73] Assignee: Mobil Oil Corporation, New York, N.Y.

[21] Appl. No.: 292,061

[22] Filed: Aug. 11, 1981

[51] Int. Cl.[3] ..... E21B 47/024
[52] U.S. Cl. ..... 73/151; 175/45; 364/422; 33/303
[58] Field of Search ..... 73/151; 175/45; 364/422; 33/303, 304, 313

[56] References Cited

U.S. PATENT DOCUMENTS

| | | | |
|---|---|---|---|
| 3,622,971 | 11/1971 | Arps . | |
| 3,759,489 | 9/1973 | Jones . | |
| 3,968,473 | 7/1976 | Patton . | |
| 4,021,774 | 5/1977 | Asmundsson . | |
| 4,231,252 | 11/1980 | Cherkson | 73/151 |
| 4,303,994 | 12/1981 | Tanguy | 33/304 |

OTHER PUBLICATIONS

Lubinski, Arthur, and Woods, H. B., "Factors Affecting the Angle of Inclination and Dog—Legging in Rotary Bore Holes".
Woods, H. B., and Lubinski, Arthur, "Practical Charts for Solving Problems on Hole Deviation," API Drilling and Production Practice, 1954, pp. 56–71.

*Primary Examiner*—Howard A. Birmiel
*Attorney, Agent, or Firm*—C. A. Huggett; M. G. Gilman; J. F. Powers, Jr.

[57] ABSTRACT

In the drilling of a well, buckling of a drill string is prevented by determining the buoyed weight, sliding friction, and external forces applied to the segments of a drill string and comparing the resultant axial force on each segment with a buckling threshold to indicate when the resultant axial force exceeds the threshold. The azimuth and inclination of segments of the drill string are measured. The forces on the drill string are resolved into the axial and normal components applied to the next shallower segment. From these, the forces applied to each segment are determined.

6 Claims, 11 Drawing Figures

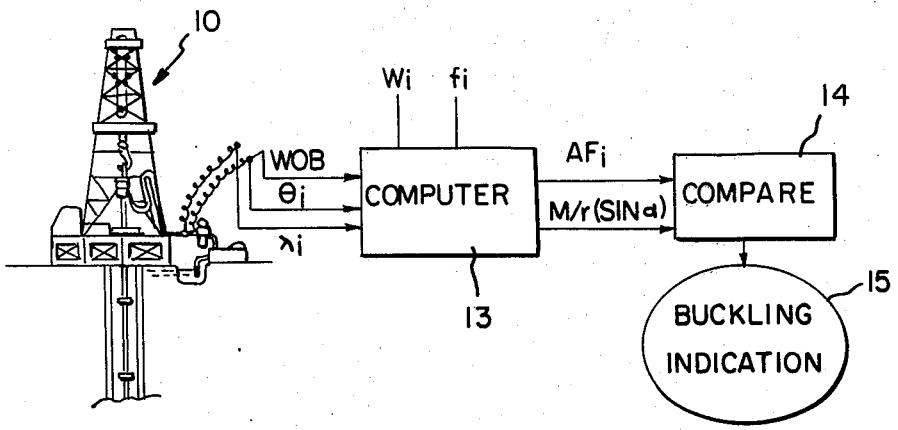
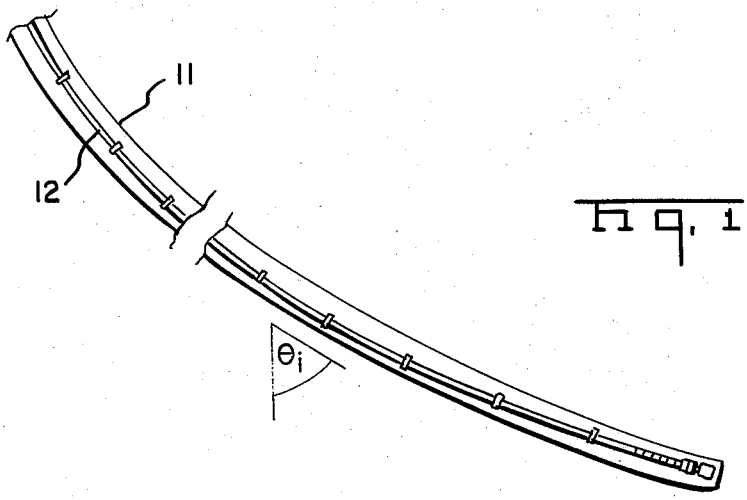
Fig. 1
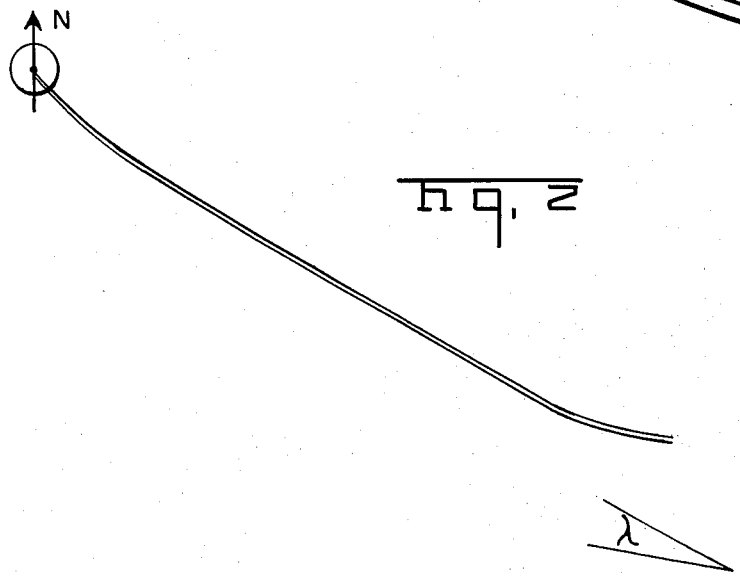
Fig. 2

CRITERIA FOR HELICAL BUCKLING

PREVENTING BUCKLING IN DRILL STRING

BACKGROUND OF THE INVENTION

This invention relates to drilling boreholes in the earth, and more particularly to preventing buckling of the drill string.

The problems encountered in drilling through the earth to very deep depths have been well documented and successfully solved. These problems are exacerbated in so-called "extended reach drilling" where the path of the drill bit deliberately deviates substantially from the vertical direction. The insertion of tubulars, drill strings, casings, and tubing into very high angle boreholes is particularly difficult.

Recently, sophisticated technology of electronic measuring and data transmission has been applied to this problem. Many state of the art systems accurately track and control the path of the drill string through the subsurface formations. For example, U.S. Pat. Nos. 3,622,971-Arps and 4,021,774-Asmundson, describe apparatus for tracking the path of a drill string through the earth from measurements of azimuth and inclination. The Arps patent includes a computer at the surface of the earth for determining the path from the down hole measurements.

U.S. Pat. No. 3,968,473 shows apparatus for measuring the weight on the drill bit and the torque applied to the drill string. U.S. Pat. No. 3,759,489 describes apparatus for automatically controlling the weight on the bit.

One problem which has not been adequately addressed is the buckling of segments of the drill string. This causes deflections which in turn cause forces against the hole wall which increase the frictional drag. Also, buckling stresses cause pipe fatigue.

Some sections of the boreholes may have inclinations 80° to 90° (or greater) from the vertical in which the pipe within that section will not slide through the hole with just the force from its own weight. In this situation, sections of the pipe have to be pushed in order to move.

As a pipe is pushed through a hole, it will flex and buckle. At each contact to the wall, an additional force will be applied against the wall of the borehole causing additional drag. This creates the cumulative situation of added drag causing needed additional axial force which causes more buckling, more force against the wall and more drag, a snowballing effect. A point will be reached where, for a given set of conditions, the force to push the pipe is not available or the pipe can fail. Many alternatives exist to change the given conditions, such as: changing the tubular strings; changing the borehole configuration, i.e., casing, or hole sizes; changing the coefficients of friction; and devising means to create a pushing force.

The criteria for buckling in a drill string are known and are described in: Lubinski, Arthur, and Woods, H. B., "Factors Affecting the Angle of Inclination and Dog-Legging in Rotary Bore Holes," API Drilling and Production Practice, 1953, pp. 222–250; and Woods, H. B., and Lubinski, Arthur, "Practical Charts for Solving Problems on Hole Deviation," API Drilling and Production Practice, 1954, pp. 56–71. The application of these criteria to indicate buckling in actual drilling situations, and in the simulation of such drilling, is an object of the present invention.

It is an object of the present invention to determine whether or not buckling of the drill string will occur under certain drilling conditions so that these conditions can be modified or avoided.

SUMMARY OF THE INVENTION

In accordance with the present invention, the axial components of the forces on each segment of a drill string are determined. The resultant axial force on each segment is compared with a buckling threshold. When the resultant axial forces exceed this threshold, a buckling tendency is indicated.

In carrying out the invention, the depth, azimuth, and inclination of each segment of a drill string are measured. The buoyed weight, sliding friction, and external forces applied to the bottom segment of the drill string are determined. For each succeedingly higher segment of the drill string, the axial forces from the next deeper segment are resolved into components related to the azimuth and inclination changes between segments. In this manner, the axial force on each segment of the drill string is determined.

The foregoing and other objects, features and advantages of the invention will be better understood from the following more detailed description and appended claims.

SHORT DESCRIPTION OF THE DRAWINGS

FIG. 1 depicts an extended reach drilling operation for which the present invention provides an indication of buckling;

FIG. 2 is a plan view depicting azimuth;

FIG. 3 depicts a series of segments with the interrelated forces;

Figure 7:
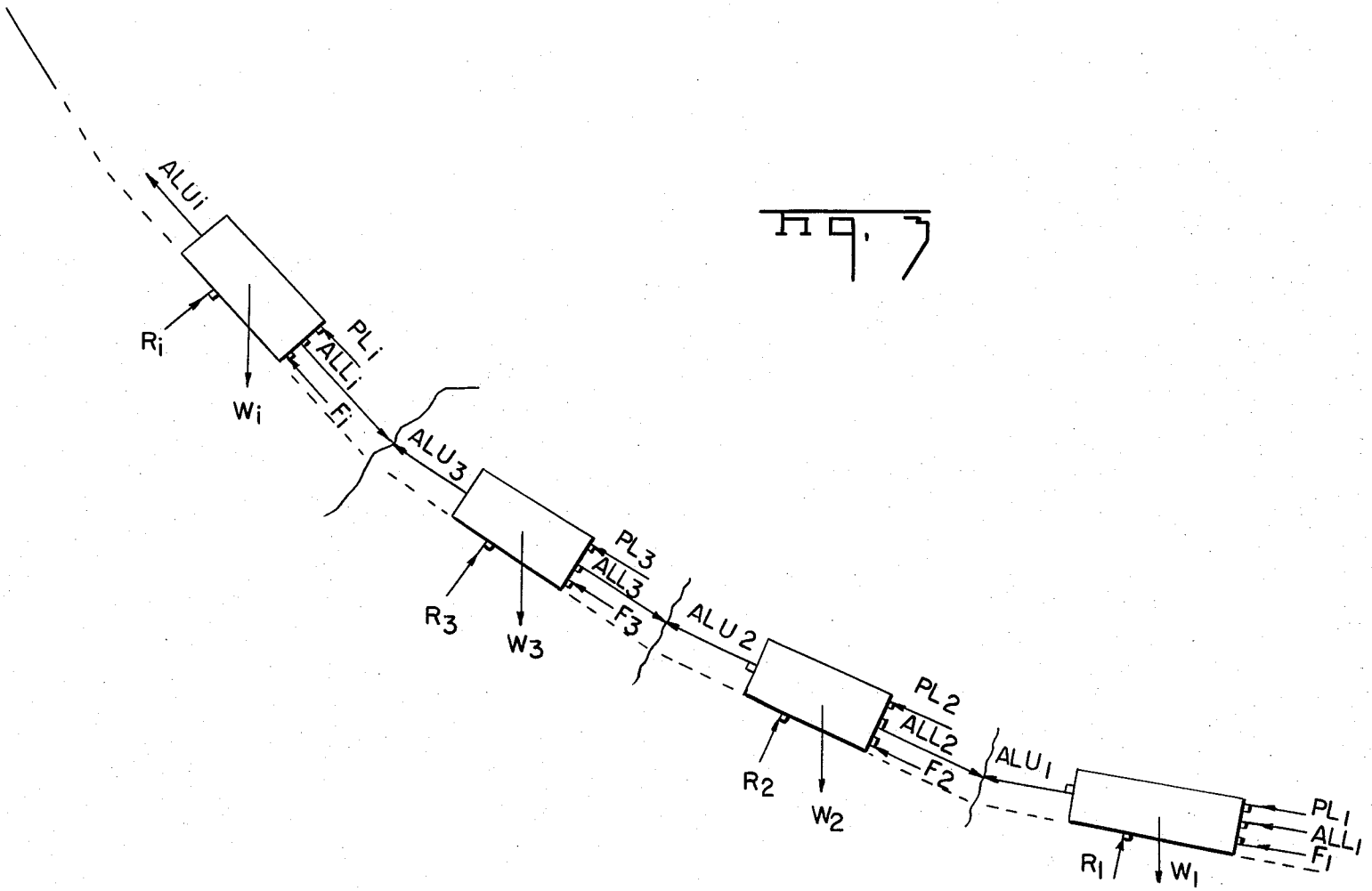
Figure 4:
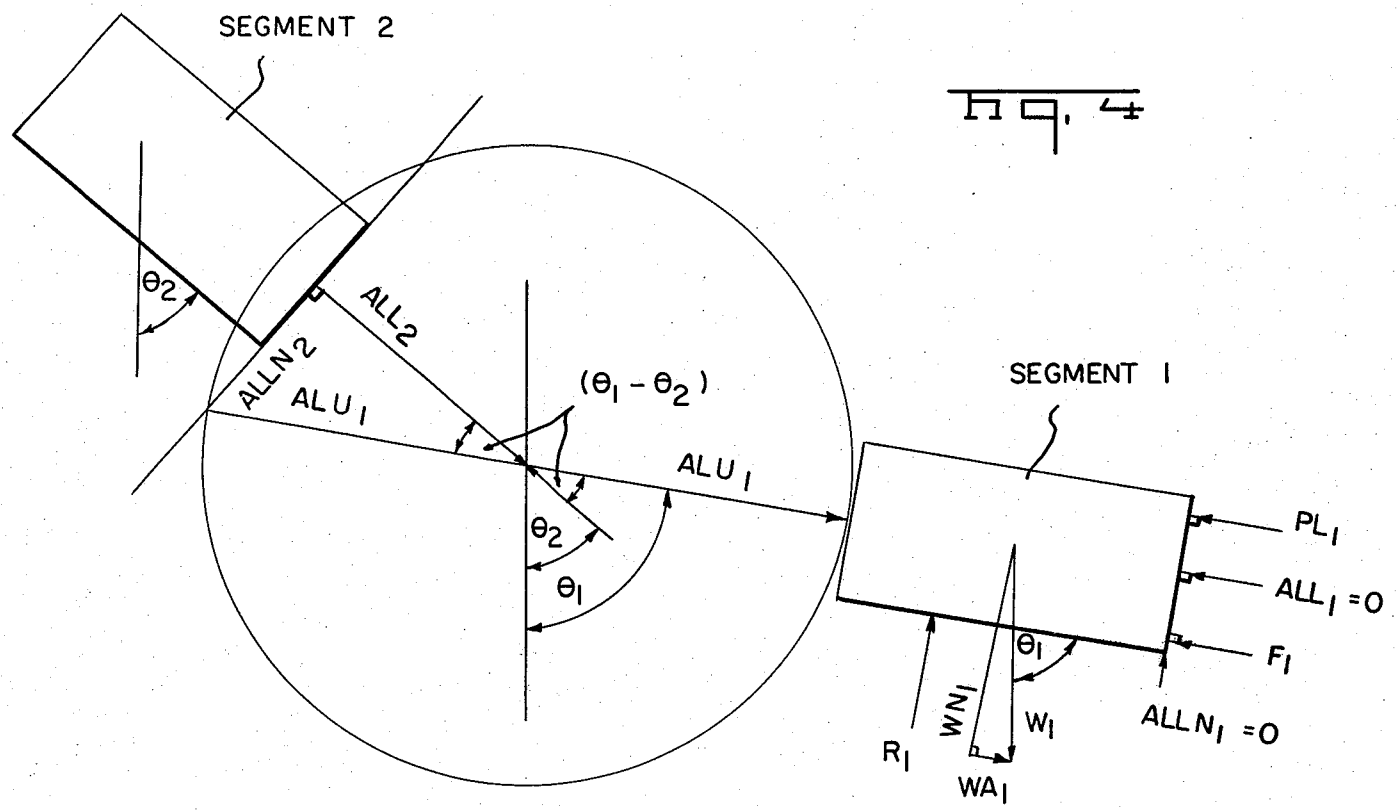
Figure 4A:
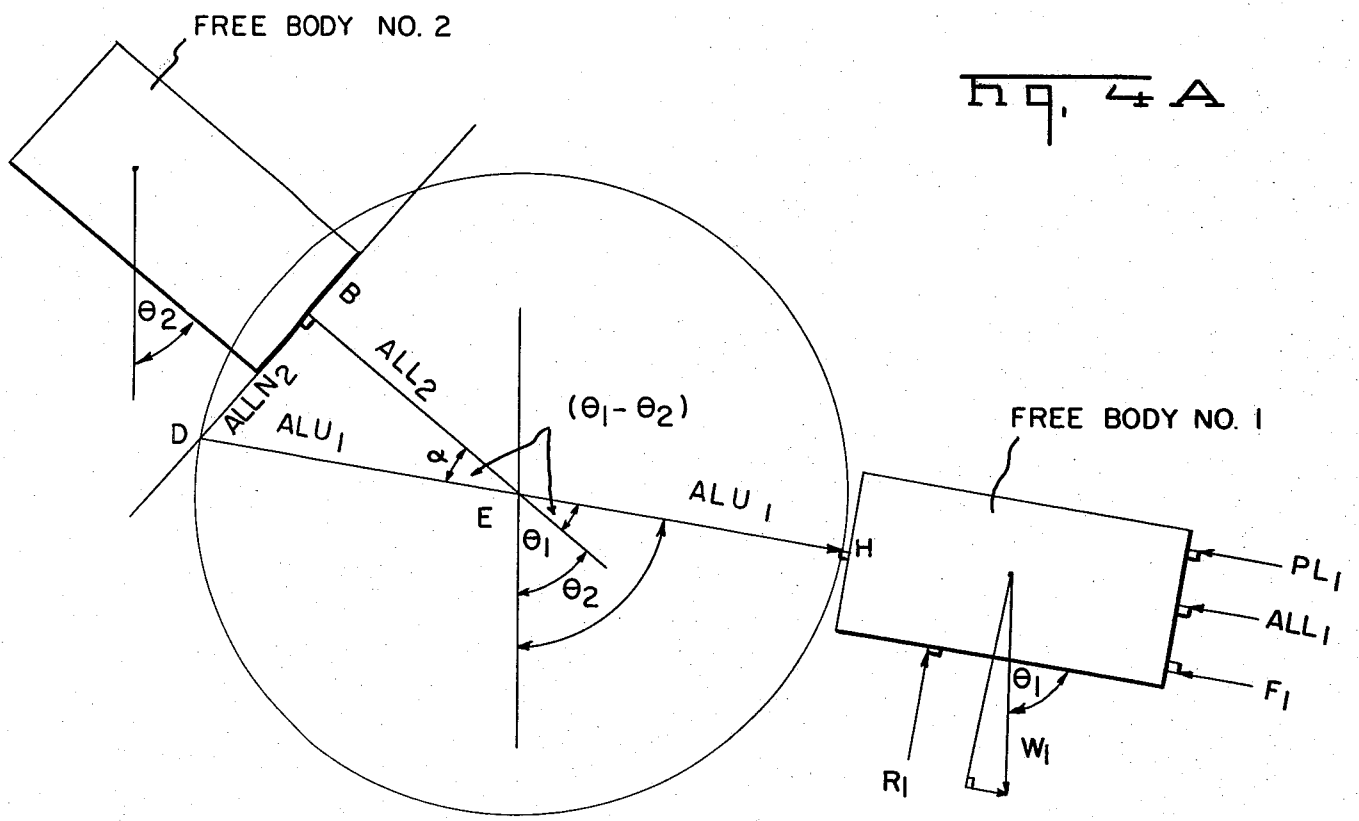
Figure 5:
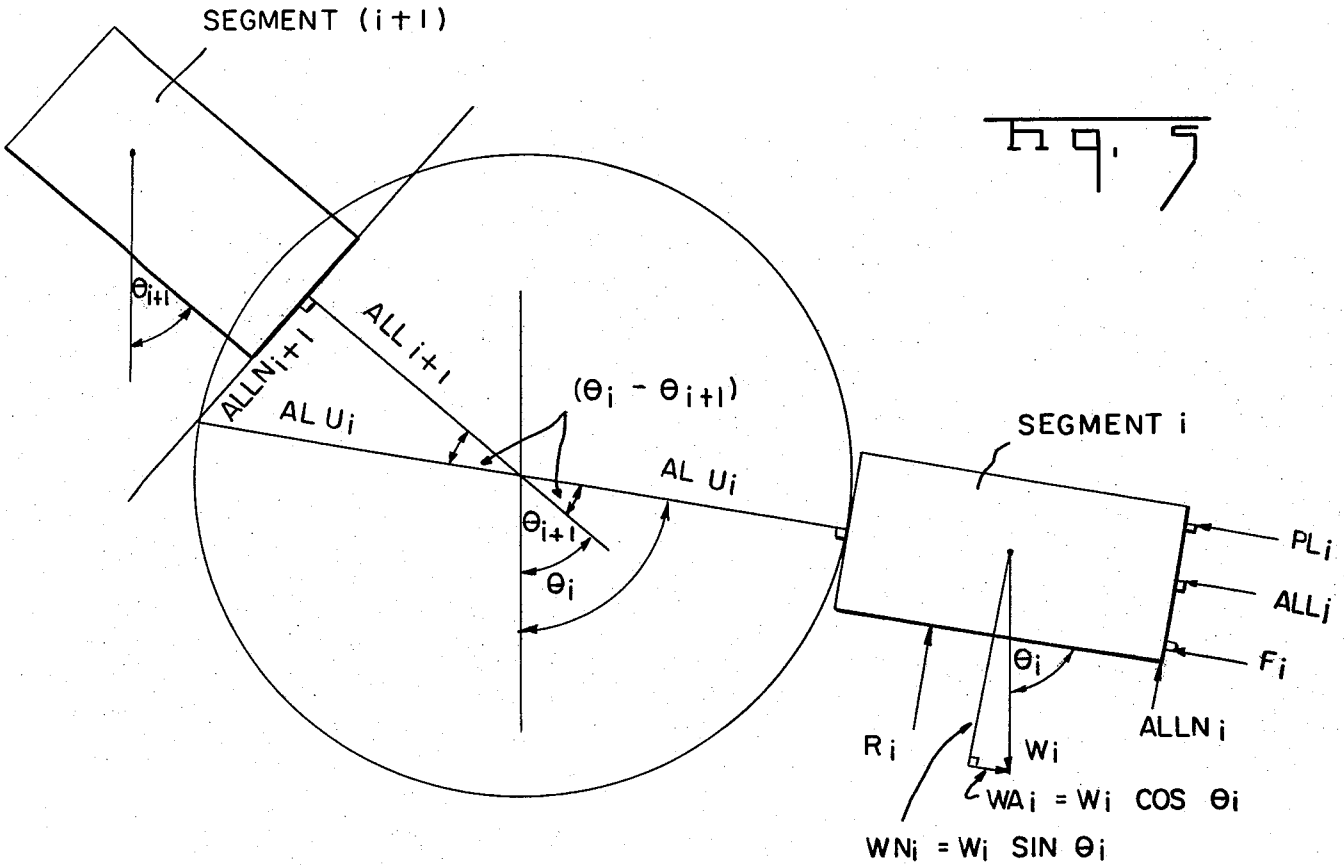
Figure 6:
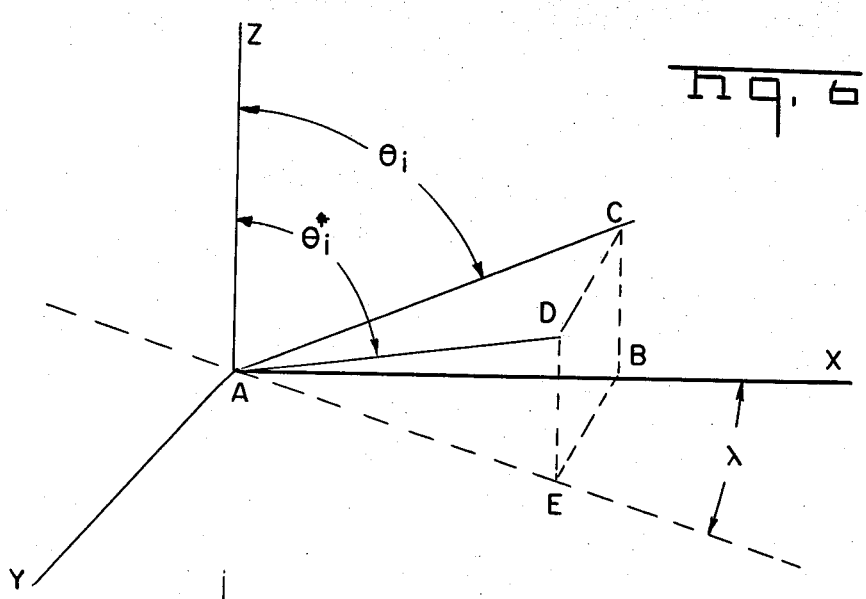
Figure 7:
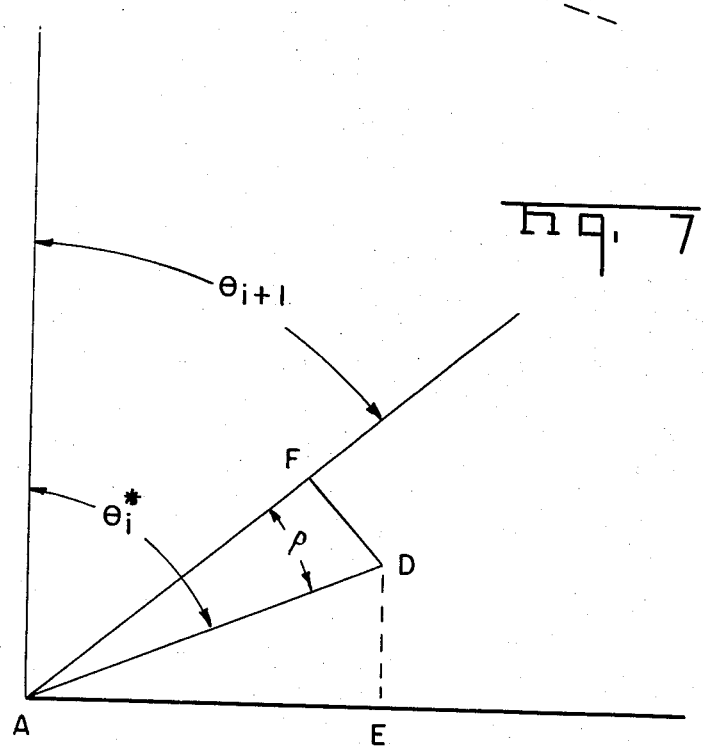
Figure 8:
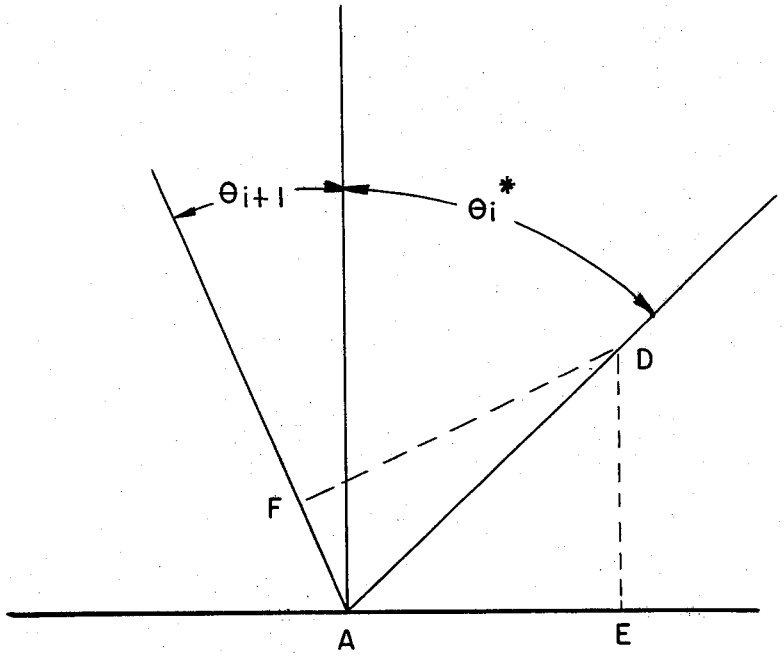
Figure 9:
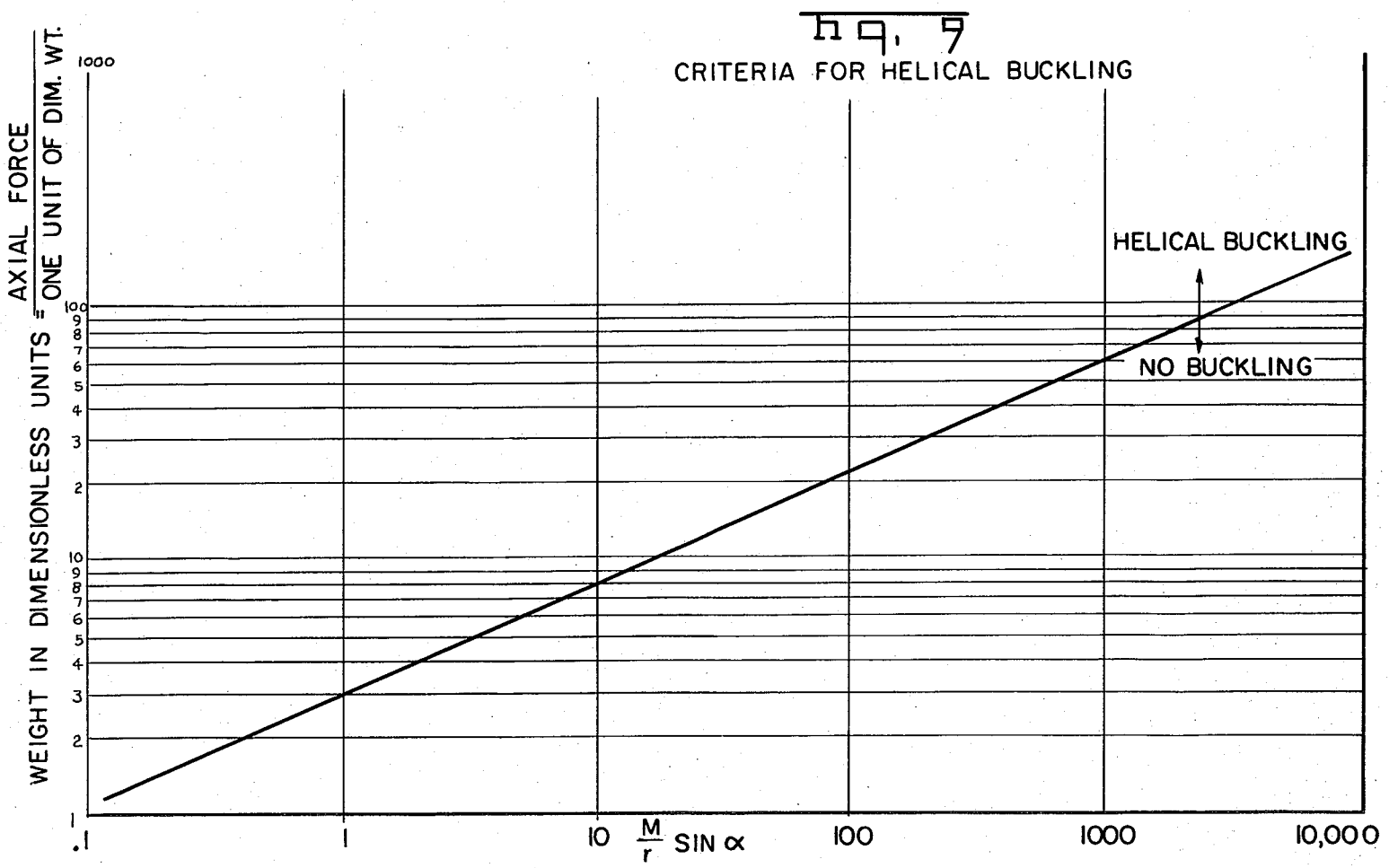
Figure 10:
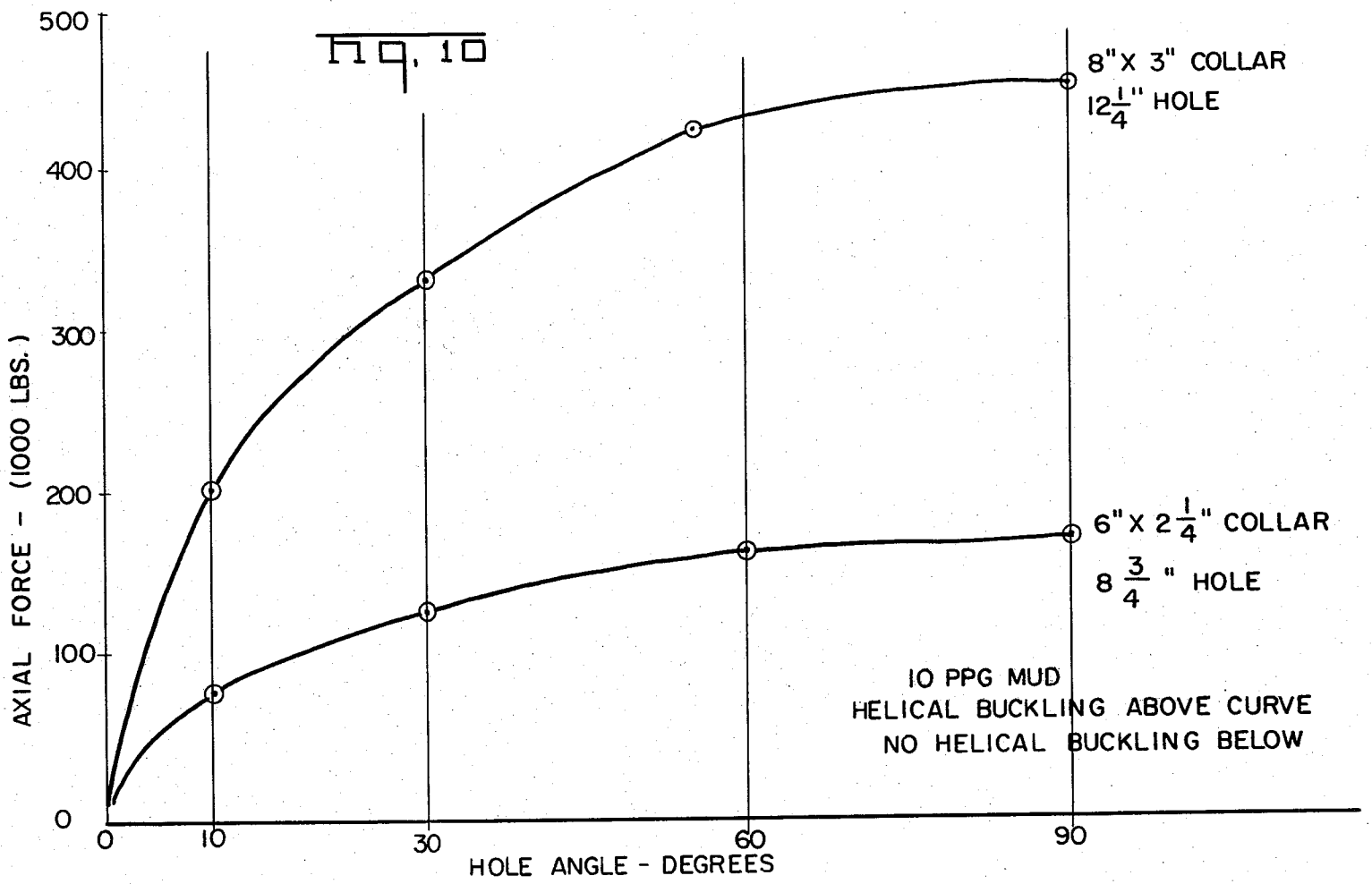

FIG. 4 and 4*a* show the vector resolutions between two segments;

FIG. 5 is similar to FIG. 4 and shows the vector resolution for any two adjacent segments;

FIGS. 6–8 show the resolution of forces between two adjacent segments in a manner which accounts for both inclination and azimuth changes between segments; and FIGS. 9 and 10 show the buckling criteria for different string and hole makeups.

DESCRIPTION OF THE PREFERRED EMBODIMENT

In FIG. 1, a conventional drilling rig 10 is disposed over a borehole 11. A drill string 12 includes the usual drill pipe, stabilizers, collars, and bit. Drilling mud is pumped from a supply sump into the drill string and is returned in a conventional manner. Changes in the drill mud pressure may be used to convey downhole parameters to the surface by using the logging while drilling apparatus described in some of the aforementioned patents. For example, the trajectory of the drill string, including inclination $\theta$ and azimuth $\lambda$ may be transmitted uphole. Also, the weight on bit (WOB) may be derived from downhole measurements, although more conventionally it is determined by measuring the forces on the drill string at the surface and deriving WOB from these measurements.

In accordance with the present invention, determination of a tendency to buckling is made segment by segment in the drill string. As used herein, the term "segment" means a short length of the drill string including bit, collars and drill pipe. Segments of equal characteristics are included in a section. For example, the drill string may be divided into the following sections:

Section 1: Bit, 1 segment.
Section 2: Eight drill collars, 8 segments.
Section 3: Drill pipe, 1 segment per joint.

The inclination of each segment is denoted $\theta_i$, where i is an index specifying successive segments starting with the segment at the bottom. Similarly, as shown in FIG. 2, the azimuth of each segment is designated by the azimuth change $\lambda_i$ between segments.

As shown in FIG. 1, the measurements of inclination and azimuth for each segment and the measurement of weight on bit are applied to a digital computer 13 which also receives as inputs the buoyed weight $W_i$ for each segment and the coefficient of of friction $F_i$ between each segment and the surrounding mud and borehole. These inputs are used to determine the axial force $AF_i$ on each segment of the drill string. The digital computer also receives as inputs parameters regarding the strength of each segment of the drill string so that a buckling criteria $M/r(\sin \alpha)$ is determined for each segment. The actual forces are compared to the buckling criteria for each segment as indicated at 14. If the axial forces exceed the threshold an indication of buckling is provided as indicated at 15.

While the borehole can be defined by an actual directional survey as indicated in FIG. 1, in the practice of the invention the borehole can also be defined by a simulated survey. As will be apparent from the following description, the present invention can be practiced on line as depicted in FIG. 1 or it can be practiced in a simulation of a well drilling operation.

FIG. 3 depicts the forces on successive segments of the drill string. For convenience, the segments are shown spaced one from the other so that the force vectors between them can be shown. These successive segments are denoted by the index 1, 2, 3 . . . i. In the actual implementation under consideration, 2,000 segments are used. Each segment has a buoyed weight W1, W2, W3, $W_i$ which is determined from the weight of the drill pipe, collars, or the like, and from the density of the drilling mud being used. Other forces which are applied to each segment include $R_1$, $R_2$, $R_3$ . . . $R_i$ which is the reaction of the borehole wall to the force applied normal to the wall; $F_1$, $F_2$, $F_3$, . . . $F_i$, which is the frictional drag in both directions of movement; and $PL_1$, $PL_2$, $PL_3$ . . . $PL_i$ which is the point load external force applied to each segment. For example, on the first segment, the external force applied would be the weight on bit. These forces are resolved into components which act along the axis of the segment and normal to the axis of the segment.

FIG. 3 shows the balance of forces over segment 1 and the force vectors applied to segment 2. These forces are defined as follows.

Axial Load Lower

ALL1=0, because segment 1 is the terminal free body on the string.

Point Load

PL1 can be bit weight and/or a hydraulic force across the end of the pipe.

Weight Axial

WA1 is the axial component of the weight, W1;

$$WA1 = W1 \cos \theta_1$$

The force vectors and components are resolved so that the Axial Load Upper, ALU1, is parallel to the axis of segment 1, and ALL2 is parallel to the axis of segment 2. FIG. 4 shows an analysis of the resolution of force vectors between the two segments when only a change of inclination is taken into account. Final resolution which accounts for azimuth change is given below. FIG. 4A shows the resolution of force vectors between segments 1 and 2. The force vector ALU1 is known from the resolution of forces on segment 1. The vectored forces applied to segment 2 are as shown. HE is parallel to segment 1. The magnitude of HE is ALU1. BE is parallel to the axis of segment 2. DH is a straight line.

$$DE = HE$$

$$BD \perp BE$$

$$\alpha = (\theta 1 - \theta 2)$$

DE and $\alpha$ are known.

BE and BD are determined as follows:

$$BE = DE \cos \alpha = DE \cos (\theta 1 - \theta 2)$$

$$DB = DE \sin \alpha = DE \sin (\theta 1 - \theta 2)$$

Knowing $\theta 1$, $\theta 2$, ALU1, and assuming the force vectors of FIG. 4A gives: ALL2 and ALLN2.

Returning to FIG. 4, assume that ALLN2 is the normal component reacting to the non-alignment of the two segments.

Axial Load Lower Normal:

ALLN2 is the component normal to the axis of segment 2 reacting to the axial load ALU1, $$ALLN2 = ALLU1 \sin (\theta 1 - \theta 2)$$

Axial Load Lower $$ALL2 = ALLU1 \cos (\theta 1 - \theta 2)$$

Reaction of the Wall

Let all the normal force components from ALL2 be taken up by segment 2 with the component ALLN2. The reaction of the wall to segment 1, R1, is the sum of all forces normal to the axis of segment 1.

Friction Force Axial

F1 is the friction force along the axis and equals the friction coefficient f1 times the sum of the forces normal to the axis.

$$F1 = f1R1$$

Summing Forces Normal to the Axis (FIG. 4)

$$R1 = WN1 + ALLN1 = 0$$

But, $ALLN1 = 0$ $$R1 = WN1 = W1 \sin \theta 1$$

Summing Forces Along the Axis (FIG. 4)

$$PL1 + ALL1 + F1 - WA1 - ALLU1 = 0$$

But, $ALL1 = 0$

*PL1* is known $W1$ is known and $WA1 = W1 \cos \theta 1$ $F1$ is known $= f1R1 = f1W1 \sin \theta 1$ Solve for ALU1, the unknown, $$ALU1 = PL1 + f1W1 \sin \theta 1 - W1 \cos \theta 1 + ALL1$$

For Reaction To the Second Free Body (FIG. 4)

The axial load to the end of segment 2 is:

$$ALL2 = ALLU1 \cos (\theta 1 - \theta 2)$$

The normal component, due to the non-alignment of the two vectors ALL2 and ALU1 is:

$$ALLN2 = ALU1 \sin (\theta 1 - \theta 2)$$

For (ith) Free Body (See FIG. 5)

FIG. 5 depicts two segments (i) and (i+1). Follow the procedure previously used to analyze segments 1 and 2.

PLi will be known
ALLi comes from analysis of (i−1) body
ALLNi comes from analysis of (i−1) body
Wi will be known
$\theta$i will be known
$\theta$i+1 will be known $$WAi = Wi \cos \theta i$$

$$WNi = Wi \sin \theta i$$

$$Fi = fi\ Ri$$

Summing Forces to the Axis of Segment (i)

$$Ri + ALLNi - WNi = 0$$

$$Ri = Wi \sin \theta i - ALLNi$$

Summing Forces Parallel to the Axis of Segment (i)

$$PLi + ALLi + Fi - WAi - ALUi = 0$$

The unknown is ALUi, $$\begin{aligned} ALUi &= PLi + ALLi + Fi - WAi \\ &= PLi + ALLi + fi\,(Wi \sin\theta\, i - ALLNi) - Wi \cos\theta\, i \end{aligned}$$

For Reaction to the (i+1) Segment $$ALLi+1 = ALUi \cos (\theta i - \theta i+1)$$

$$ALLNi+1 = ALUi \sin (\theta i - \theta i+1)$$

The inclusion of azimuth changes in the borehole profile necessitates a further resolution of the forces acting on each drill string segment. This resolution is depicted in FIGS. 6, 7, and 8.

As before, each segment is considered to be a free body in equilibrium. The forces on the body are axial, normal and torsional. The axial forces are:

1. The axial component of the segment buoyed weight.
2. The sliding friction force.
3. An externally applied force, if any, assigned to represent weight-on-bit, for example.
4. The axial component of the force on the body from the next deeper segment.

The normal forces are:

1. The normal component of the segment buoyed weight, acting in the vertical plane through the segment.
2. The normal component of the axial force from the next deeper segment, acting in the vertical plane of the segment.
3. The normal component of the axial force from the next deeper segment, acting perpendicularly to the vertical plane of the segment.

The torsional forces are:

1. The cumulation of applied torque at the bottom of the drill string minus torque loss due to friction for all of the string deeper than the segment.
2. The torque loss due to friction for the segment. The resultant of the axial forces acts on the next shallower segment. The resultant of the normal forces determine the torsional and axial friction forces.

Of the above described forces, only those three that are components of the resultant axial force from the next deeper segment are related to azimuth and inclination changes between segments. Consider FIG. 6.

The resultant axial force from the next deeper segment lies in the vertical plane X-Z, has a length AC, and has an inclination $\theta_i$. Let $\lambda$ be the azimuth change between segments. The vertical plane A-D-E contains the current segment. The force AC can be resolved into two components, AD in the plane of the current segment, and CD perpendicular to the current vertical plane. In the current plane, AD has an inclinatin of $\theta_i^*$.

$$BC = DE = AC \cos \theta_i \quad (1)$$

$$AB = AC \sin \theta_i \quad (2)$$

$$BE = CD = AB \sin \lambda \quad (3)$$

$$AE = AB \cos \lambda \quad (4)$$

$$AD = \sqrt{DE^2 + AE^2} \quad (5)$$

$$\theta_i^* = \cos^{-1} (DE/AD) \quad (6)$$

In the vertical plane of the current segment, ADE, the segment has an inclination of $\theta_{i+1}$. The component AD from the deeper segment must be resolved into two components in the vertical plane ADE, an axial component along the inclination $\theta_{i+1}$, and a normal component perpendicular to the segment i+1. Consider FIG. 7 in the vertical plane of the current segment.

$$\text{Let } \rho = \theta_{i+1} - \theta_i^* \quad (7)$$

$$AF = AD \cos \rho \quad (8)$$

$$FD = AD \sin \rho \quad (9)$$

Thus, the axial resultant force from body i, AC, is resolved into the three components CD perpendicular to the plane ADE, AF in the plane ADE along the axis of body i+1, and DF in the plane ADE normal to the axis of the body i+1.

In the above analysis, $\lambda$ is the smaller of the two angles at the intersection of the two vertical planes. Let $\delta$ be the azimuth change between segments i and i+1. If $\delta$ is less than 90°, then $\lambda = \delta$. However, if the azimuth change is greater than 90°, as will possibly occur in the more vertical portion of the wellbore, then the inclination angles $\theta_{i+1}$ and $\theta_i^*$ will be measured in opposite directions. Consider FIG. 8.

In this case, $\rho = -\theta_{i+1} - \theta_i^*$. Further, as will be shown later, the normal component of the buoyed weight of segment i+1 must have an upward direction in order to be consistent with the sign convention chosen.

The sign convention is that axial forces are positive if they act toward the deep end of the borehole and are negative if they act toward the top of the hole. As a result of this convention, axial friction forces are positive if the drill string is being pulled out of the hole and are negative if the drill string is going into the hole.

In this manner, the resultant axial forces $AL_i$ are determined. This axial force is compared to the buckling criteria as previously indicated. Criteria for helical buckling are given by the Lubinski and Woods articles cited above. In their FIG. 2, dashed portions of Curves 1, 2, and 3 indicate conditions where helical buckling will occur. FIG. 2 was developed assuming the hole angle, $\alpha$, to be "small". In their later article, Lubinski and Woods extended the theory to include the effect of $\alpha$, even if the angles were "large". They demonstrated that FIG. 2 could be used as shown without modification, provided the scales are changes. The abscissa should be changed from $\alpha m/r$ (symbols to be explained later) to m/r (sin $\alpha$), and the ordinate from $\phi/\alpha$ to [sin $\alpha$-gan ($\alpha$-$\phi$)]/sin $\alpha$. Therefore, the remainder of this discussion of buckling criteria will be based on the Lubinski and Woods FIG. 2 but with scale change as indicated.

In FIG. 2, Curve 3 is for a "dimensionless weight" of 2 units, and helical buckling occurs when m/r (sin $\alpha$) equals 0.4. Likewise, Curve 2 is for a "dimensionless weight" of 4 units with m/r (sin $\alpha$) for buckling equal 2, and Curve 3 is for a "dimensionless weight" of 8 units with m/r (sin $\alpha$) equal 10 for buckling.

Table 1, below, lists these values and contains extrapolated values to higher "dimensionless weights".

TABLE 1

| Weight in Dimensionless Units | m/r (sin$\alpha$) |
|---|---|
| 2 | .4 |
| 4 | 2 |
| 8 | 10 |
| 16 | 50 |
| 32 | 250 |
| 64 | 1250 |

We now have all the information necessary to develop simple, easily programmed criteria for helical buckling. Lubinski and Woods use a term which they call a "dimensionless unit". The dimensionless unit has a length and a weight. The length in feet of one dimensionless unit is:

$$m = \frac{\sqrt[3]{El}}{p}$$

and the weight in pounds of one dimensionless unit is $$pm = \sqrt[3]{Elp^2}$$

where:

| | |
|---|---|
| E = Young's modulus = $30 \times 10^6$ psi = $4.32 \times 10^9$ lbs/ft$^2$ | for steel |
| = $10.6 \times 10^6$ psi = $1.53 \times 10^9$ lbs/ft$^2$ | for aluminum |

p = weight of pipe per unit length in mud, lbs/in or lbs/ft $I$ = moment of inertia, ft$^4$ or in$^4$
$= \pi/64\,(Do^4 - Di^4)$ Do = pipe outside diameter
Di = pipe inside diameter In addition, $\alpha$ is the angle of the hole with respect to vertical and r is the radial clearance between the pipe outside diameter and hole wall.

$$r = \frac{D_H - D_O}{2}, \text{ feet}$$

here $D_H$ = hole diameter

We can evaluate buckling in terms of the axial compressive force in the pipe thus:

$$\text{weight in dimensionless units} = \frac{\text{axial force}}{\text{weight of one dimensionless unit}} = \frac{AF}{mp}$$

We now have all of the terms necessary to evaluate (M/r) (sin $\alpha$) for any pipe size, hole diameter and hole angle.

FIG. 9 shows Table 1 plotted on log-log paper as the weight in dimensionless units $$\left(\text{equal to } \frac{AF}{mp}\right) \text{ vs. } \frac{M}{r}\,(\sin\alpha).$$

The equation of the curve is:

$$\frac{AF}{mp} = 2.93\left[\left(\frac{m}{r}\right)\sin\alpha\right]^{0.436}$$

Therefore, helical buckling will occur when:

$$AF \geqq 2.93\,(mp)\left[\left(\frac{m}{r}\right)\sin\alpha\right]^{0.436}$$

EXAMPLE

6" O.D.×2¼ I.D. collars in 8¾" hole
p = 82.6 #/ft in air = 70.2 #/ft (5.85 #/in) in 10 ppg mud $$I = \frac{\pi}{64}\,(6^4 - \overline{2.25^4}) = 62.3 \text{ in}^4$$

$$E = 30 \times 10^6 \text{ psi}$$

-continued $$m = \sqrt[3]{\frac{30 \times 62.3 \times 10^6}{5.85}} = 683 \text{ in} = 57 \text{ ft}$$

$$mp = 57 \times 70.2 = 4000 \text{ lbs}$$

$$r = \frac{8.75 - 6}{2(12)} = 0.115 \text{ ft}$$

If $\alpha = 60°$, $$AF = 2.93\ (4000)\ (57/.115)\ (\sin 60)^{0.436} = 164{,}800 \text{ lbs}$$

The complete curve of AF vs. hole angle for 6"×2¼" collars in an 8¾" hole is shown in FIG. 10. Also shown in FIG. 10 is AF vs. hole angle for 8"×3" collar in a 12¼" inhole.

The symbols used in the force equations is one computer for practicing the invention as defined below (for segment i+1)

W=buoyed weight of segment
WA=axial weight component
WN=normal weight component (in vertical plane)
PL=assigned point load on the segment, if any
FA=axial sliding friction force
ALU(i)=resultant axial force for the next deeper segment
ALL=axial component of ALU(i) onto i+1
ALLN=vertical plane normal component for i+1 of ALU(i)
ALLH=horizontal normal component of ALU(i)
RN=resultant normal force on i+1
CF=coefficient of sliding friction
SF=plus or minus 1 to determine the sign of the friction force according to the sign convention The angles used are $\theta_{i+1}$=average inclination of segment i+1
$\theta^*(i)$=inclination of projection of ALU(i) onto the vertical plane of i+1
$\rho$=the change in inclination between segments the vertical plane of i+1
$\beta(i+1)$=average azimuth of i+1
$\delta$=the change in azimuth between segments
$\lambda=\delta$ if $\lambda$ less than or equal to 90°, or $180°-\delta$ for $\delta$°greater than 90°

The force equations for segment i+1 are given below $$WA = W \cos [\theta(i+1)] \quad (10)$$

$$WN = W \sin [\theta(i+l)] \text{ for } \delta \leqq 90° \quad (11)$$
$$= W \sin [-\theta(i+l)] \text{ for } \delta \geqq 90° \quad (12)$$

$$RN = SQRT\ ((ALLN+WN)^2 + ALLH^2) \quad (13)$$

$$FA = SF \times CF \times RN \quad (14)$$

$$ALU\ (i+1) = FA + ALL + PL + WA \quad (15)$$

where ALL, ALLN, and ALLH are calculated as projections of the ALU(i) from the next deeper segment. That is, equations 1 through 9 above apply where, $$AC = ALU(i) \quad (16)$$

$$ALL = AF \quad (17)$$

$$ALLN = FD \quad (18)$$

$$ALLH = CD \quad (19)$$

Note that the equation for RN, the resultant normal force, involves the square of ALLH and of ALLN+WN. This means that the sign of ALLH is unimportant and only the relaive signs of WN and ALLN are important.

The equation for torsional friction loss is:

$$DTQ = CFT \times RN \times DIA/24 \quad (20)$$

where DTQ=incremental torsional friction loss in segment i+1
CFT=torsional coefficient of friction
RN=resultant normal force
DIA=outside diameter of segment i+1

Several possible relationships among azimuth changes, inclination changes, and the direction of the axial force ALU(i) from the deeper segment are of interest.

1. If there is no azimuth change, $\lambda=0$, so $$ALLH = CD = AB \sin \lambda = 0$$

$$AD = AC = ALU(i)$$

$$\theta_i^* = \theta_i$$

$$\rho = \theta_{i+1} - \theta_i$$

$$ALL = AF = ALU(i) \cos \rho$$

$$ALLN = FD = ALU(i) \sin \rho$$

$$RN = |ALLN + WN|$$

2. For an azimuth change less than 90°,
   (a) ALL has the same sign as ALU(i) as long as $\rho$ is less than 90°. For $\rho$ greater than 90°, an impractical case, the profile bend is an acute angle and ALL acts in a direction opposite to ALU(i).
   (b) ALLN has the same sign as ALU(i) for positive $\rho$ and the opposite sign for negative $\rho$. That is, if the profile is building angle, $\rho$ is negative, and if ALU(i) is negative (acting toward the surface) then ALLN acts in the same direction as WN. If the profile is dropping angle, $\rho$ is positive, and if ALU(i) is negative, then ALLN is opposite in direction to WN.
3. For an azimuth change greater than 90°, (an impractical case unless inclinations are near vertical), the angle $\rho$ is defined to be $-\theta_{i+1} - \theta_i^*$. Because of this definition,
   (a) ALLN is always opposite in sign to ALU(i) so if ALU(i) is negative (toward the surface) the sign of ALLN will be positive. The geometry shows that for $\theta_{i+1}$ and $\theta_i^*$ in opposite directions, if ALU(i) is negative, ALLN should be opposite in sign to WN. Therefore, to be consistent, the sign of WN is made negative if the azimuth change is greater than 90°.
   (b) ALL has the same sign as ALU(i) as long as the absolute value of $\rho$ is less than 90°. If the absolute value of $\rho$ is greater than 90°, ALL will act in an opposite direction to that of ALU(i).
4. For no azimuth and inclination change, $$ALL = ALU(i)$$
$$ALLN = ALLH = 0$$

As a result of the way the above force equations are defined, there are no profile restrictions on either the change in azimuth or the change in inclination between segments as far as the program calculations are concerned. Of course, practically, azimuth and inclination changes are limited to the ability to change hole direction while drilling so the above equations are more general than necessary.

The invention can be practiced using several different types of commercially available general purpose digital computers. One actual system which was used in practicing the invention was the Control Data Corp. Cyber 170–750 computer.

The programming required for the practice of the invention will be apparent from the foregoing and from the users' manuals for the particular computer which is used.

While a particular embodiment of the invention has been shown and described, modifications are within the true spirit and scope of the invention. The appended claims are, therefore, intended to cover all such modifications.

What is claimed is:

1. The method of preventing buckling of a drill string during drilling of a well in the earth comprising:

measuring the forces on, and azimuth and inclination of, segment of said drill string;

resolving said forces into the axial and normal components applied to the next shallower segment, said axial and normal components being related to measured azimuth and inclination of said segments;

determining the buoyed weight, sliding friction, and external forces applied to said segment of said drill string;

repeating the aforesaid steps for successively shallower segments of said drill string;

comparing the resultant axial force on each segment of said drill string with a buckling threshold; and indicating when said resultant axial force on any segment exceeds said threshold.

2. The method recited in claim 1 wherein the step of resolving includes:

resolving the buoyed weight, friction and external forces into the axial component along said segment based on the azimuth and inclination of said segment; and resolving said axial component into the axial force applied to the next shallower segment based on the azimuth and inclination of the last named segment.

3. The method recited in claim 1 wherein the components of said forces normal to each segment are multiplied by the coefficient of friction to determine the sliding friction for each segment.

4. The method recited in claim 1 wherein the torsional forces reacting each segment are determined and the cumulative torsional forces are determined on all the segments.

5. The method recited in claim 1 wherein the lowest segment includes a drill bit and wherein the external force applied to said lowest segment is weight on bit.

6. The method recited in claim 1 wherein simulated values are used to predict changes in forces on the drill string corresponding to the simulated values.

* * * * *

UNITED STATES PATENT AND TRADEMARK OFFICE

CERTIFICATE OF CORRECTION

PATENT NO. : 4,384,483

DATED : May 24, 1983

INVENTOR(S) : Thomas B. DELLINGER ET AL

It is certified that error appears in the above—identified patent and that said Letters Patent is hereby corrected as shown below:

Column 4, line 53, delete "R1=WN1+ALLN1=0" and substitute therefor --R1-WN1+ALLN1=0--.

Column 7, line 29, delete "[sinαa-gan" and substitute therefor --[sinαa-tan--.

Signed and Sealed this

*Twenty-second* Day of *November 1983*

[SEAL]

*Attest:*

GERALD J. MOSSINGHOFF

*Attesting Officer*

*Commissioner of Patents and Trademarks*